US005649852A

United States Patent [19]

Zepp

[11] Patent Number: 5,649,852

[45] Date of Patent: Jul. 22, 1997

[54] SANDING APPARATUS

[76] Inventor: Philip H. Zepp, 354 Edgewood SE., N. Canton, Ohio 44720

[21] Appl. No.: 553,883

[22] Filed: Nov. 6, 1995

[51] Int. Cl.[6] ..... B24B 47/10

[52] U.S. Cl. ..... 451/157; 451/124

[58] Field of Search ..... 451/177, 178, 451/120, 119, 124, 155, 157, 358, 294, 360, 304, 415

[56] References Cited

U.S. PATENT DOCUMENTS

| | | | |
|---|---|---|---|
| 1,001,573 | 8/1911 | Alter | 451/360 |
| 1,383,601 | 7/1921 | Conners | 125/37 |
| 2,244,813 | 6/1941 | Tommerup | 451/154 |
| 2,519,542 | 8/1950 | Carey et al. | 451/155 |
| 2,555,048 | 5/1951 | Long | 451/294 |
| 2,930,164 | 3/1960 | Metoff | 451/155 |
| 3,312,118 | 4/1967 | Aubert | 451/124 |
| 4,984,640 | 1/1991 | Gillan | 173/123 |
| 5,402,604 | 4/1995 | Hashii et al. | 451/155 |
| 5,402,605 | 4/1995 | Paules | 451/157 |

OTHER PUBLICATIONS

Delta–Oscillating Spindle Sander Attachment Cat. No. 17–960 Printed Apr. 1995.

ATM Power Tools Plus–Permatrak Full Function Drill Press—Cat Expiration Date Dec. 31, 1995.

*Primary Examiner*—Robert A. Rose

[57] ABSTRACT

A variable reciprocating and rotating sanding apparatus comprises a drive shaft that is partially surrounded by first and second cams. The cams cooperate to form a cam track. A cross shaft is connected to the drive shaft and extends outwardly therefrom. The cross shaft is disposed in the cam track and serves to drive the cams in response to rotation of the drive shaft. An adjustable housing surrounds the cams and supports a sanding surface. The housing comprises a tapered housing and an expansion sleeve. The expansion sleeve has a plurality of slots allowing the diameter of the expansion sleeve to expand as the expansion sleeve is slid over the tapered housing. The expansion sleeve expands outwardly against the sanding sleeve to frictionally support the sanding sleeve.

20 Claims, 4 Drawing Sheets

SANDING APPARATUS

BACKGROUND—FIELD OF INVENTION

The present invention relates generally to a device which provides rotational and reciprocating motion when driven externally by a rotating member and more specifically to power tools used for sanding, cutting and filing and more particularly a sanding tool for attachment to a drill press.

Broadly stated, the invention, to be described in greater detail below, is directed to a device particularly adaptable as an accessory device for a rotary drill press for sanding. The invention, a self contained sanding apparatus, receives its rotary motion from being mounted in a drill press chuck and generates its reciprocating motion from internal means without any other external connections.

BACKGROUND OF THE INVENTION

Rotary drum sanders are typically built as stand-alone machines. These machines have a flat work surface used to support the work piece. A vertical rotary/reciprocating spindle extends through the flat work surface. The vertical spindle is fitted with a sanding drum that provides an abrasive surface to cut the work piece. To use the machine, the operator places the work piece on the flat work surface and moves the work piece against the rotating/reciprocating sanding drum applying sufficient pressure to cause the sanding media to remove material from the work piece.

Stand-alone machines are quite costly and home shop owners often cannot afford them. These machines also reciprocate at a fixed rate regardless of the sanding load. Ideally, faster reciprocation is required during heavy sanding to clean out the sanding media because greater amounts of material are removed. Faster reciprocation prevents the work piece from burning and also extends the working life of the sanding media. Light sanding is more effective using slower reciprocation because it permits more accurate positioning of the work piece to the sanding drum. Naturally, a stand alone machine requires additional floor space which in many cases is not available in a handyman's shop.

Another method for creating a reciprocating drum sanding apparatus involves placing a drum sanding attachment in a drill press. The drill press motor provides the rotation for sanding. The sanding apparatus typically has a center shaft with an outer cylindrical shaped member fitted with a sanding drum. The drill press is further fitted with a mechanism that reciprocates the drill press quill providing essentially the same action as the stand alone machine. One disadvantage of this mechanism is its relative high cost. Another disadvantage is that the mechanism requires a minor assembly fitting for each make of drill press. Yet another disadvantage is that the mechanism must be disassembled before the drill press can be used for its intended purpose. A further disadvantage is that the mechanism only provides a fixed rate of reciprocation. Attachment mechanisms of this type may be seen, for example, in the following U.S. Pat. No. 2,244,813 to Tommerup; U.S. Pat. No. 2,555,048 to Long; U.S. Pat. No. 2,519,542 to Carey; U.S. Pat. No. 2,930,164 to Metoff; and, U.S. Pat. No. 5,402,605 to Paules.

A third method to produce rotary/reciprocating sanding motion for use with a drill press is disclosed by the apparatus shown in U.S. Pat. No. 3,312,118 to Aubert. The Aubert apparatus discloses a sanding apparatus that has the upper end of the apparatus affixed to the drill press chuck and the lower extremity being secured to the drill press table. The Aubert apparatus is complex and requires costly machining techniques for construction and special provisions to secure the lower extremity to the drill press base. These deficiencies often render the Aubert apparatus too expensive for use in the handyman's shop.

A fourth method for creating reciprocating and rotary sanding motion involves using a conventional drum sanding attachment in a drill press without any means of reciprocation except by reciprocating the drill press quill manually. Successful manual movement is nearly impossible to accomplish since an operator needs to use both hands to guide the work piece against the sanding drum. If sanding is performed without reciprocation the sanding media loads up with work piece cuttings. "Loaded" sanding media defaces the work piece by burning and renders the sanding media unfit for further sanding.

In summary the prior art has the following disadvantages: the cost and space required for a stand alone drum sanding machine is prohibitive for many handyman shops limiting marketing potential; the cost of adding a reciprocation mechanism to a handyman's drill press is prohibitive and requires fitting of the mechanism to each different make of drill press; using a drum sanding attachment on a drill press without reciprocation results in poor abrasive life and work piece burning because of abrasive loading; and, the prior art lacks a sanding apparatus having load sensitive variable reciprocating rate.

OBJECTS AND ADVANTAGES OF THE INVENTION

It is, therefore, the primary object of the present invention to provide a self-contained, reciprocating and rotating sanding apparatus that requires no modifications to the drill press that provides the rotary motion to power the invention.

It is another object of the present invention to provide a self-contained, reciprocating and rotating sanding apparatus that is as simple to install and remove from a drill press as a drill bit.

It is a further object of the present invention to provide a self-contained, reciprocating and rotating sanding apparatus that through the inner action of internal cams provides faster reciprocation rate for a heavy sanding load, increasing work piece material removal and extending the sanding media life.

It is yet another object of the present invention to provide a self-contained, reciprocating and rotating sanding apparatus that through the inner action of the internal cams provides slower reciprocation rate for a light sanding load, permitting accurate positioning of the work piece against the sanding media.

It is still another object of the present invention to provide a self-contained, reciprocating and rotating sanding apparatus that permits the molding of major components allowing the invention to be mass produced and marketed at a reasonable cost.

It is yet a further object of the present invention to provide a self-contained, reciprocating and rotating sanding apparatus that may be used with other tools such as grinders, polishers, and the like.

It is another object of the present invention to provide a self-contained, reciprocating and rotating sanding apparatus that may provide a fixed rotating member so that all rotary motion is converted to reciprocating motion making this invention applicable to tools requiring only reciprocating motion.

In general, the present invention overcomes the deficiencies of prior known reciprocating and rotating sanding devices by providing a self-contained design that requires no drill press modifications and through the use of internal mechanisms, provides a variable rate of reciprocation. The present invention is designed for mass production methods that will provide low manufacturing costs. The present invention is generally accomplished by a sanding apparatus, comprising a drive shaft; a sanding surface at least partially surrounding the drive shaft; and, cam means operatively confined between the sanding surface and the drive shaft for transforming constant rotary motion applied to the drive shaft to variable motion in the sanding surface. Other objects of the present invention are obtained by an apparatus comprising a drive shaft; a cross shaft connected to the drive shaft; the cross shaft having first and second ends; first and second cams partially surrounding the drive shaft; the first and second cams cooperating to form a cam track; the first end of the cross shaft being disposed in the cam track; and, a sanding surface operatively connected to the cams.

These and other objects of the invention, as well as the advantages thereof over existing and prior art forms, which will be apparent in view of the following detailed specifications, are accomplished by means hereafter described and claimed.

One exemplary reciprocating rotating sanding apparatus and various modified components thereof, which collectively embody the concepts of the present invention are shown by example in the accompanying drawings and are described in detail without attempting to show all of the various forms and modifications in which the invention might be embodied; the invention being measured by the appended claims and not by the details of the specification.

Still further objects and advantages will become apparent from consideration of the ensuing description and drawings.

DETAILED DESCRIPTION OF AN EXEMPLARY EMBODIMENT

Figure 1:
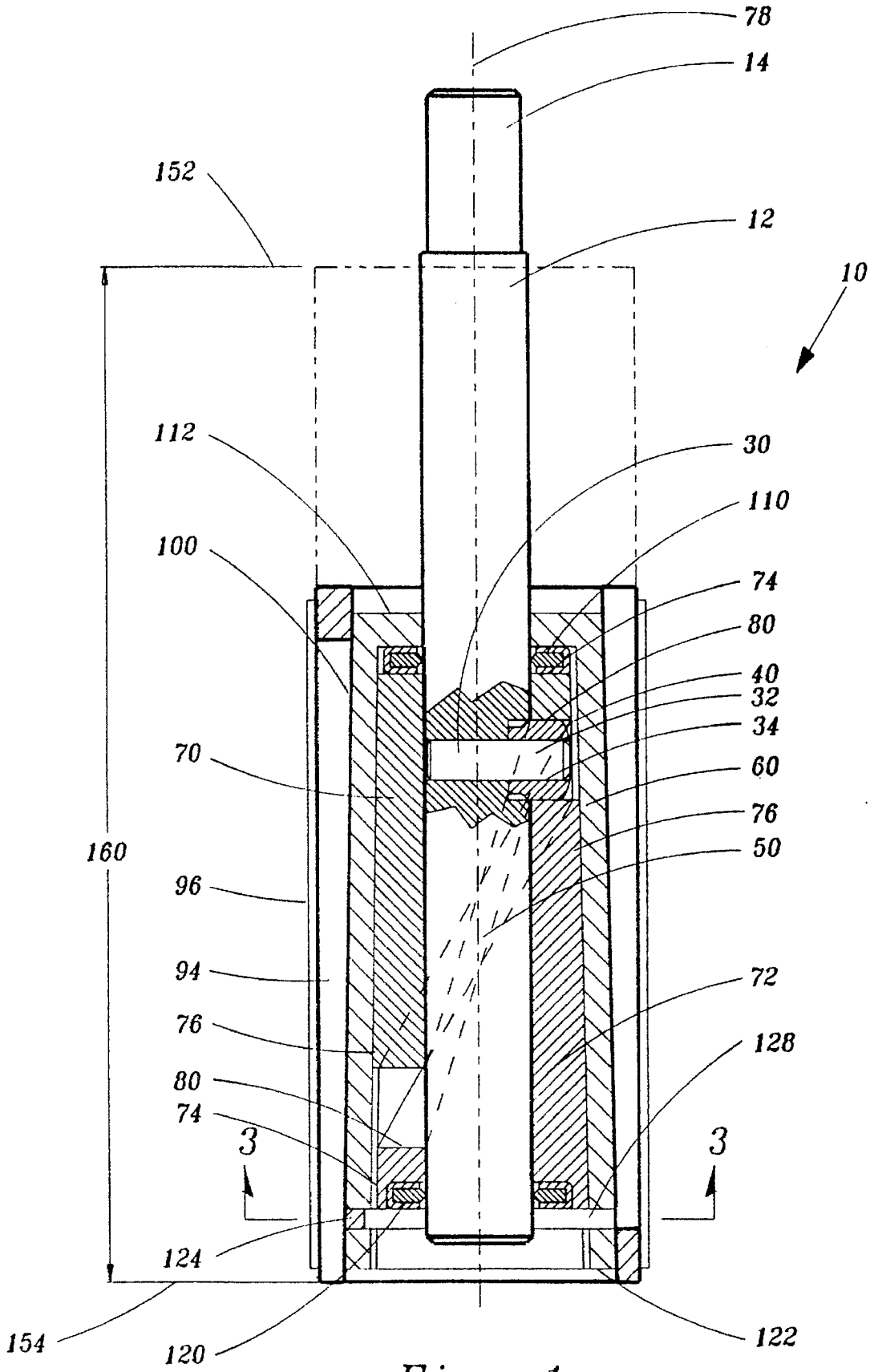
FIG. 1 is a cross sectional view taken through the longitudinal center line of the invention.
Figure 2:
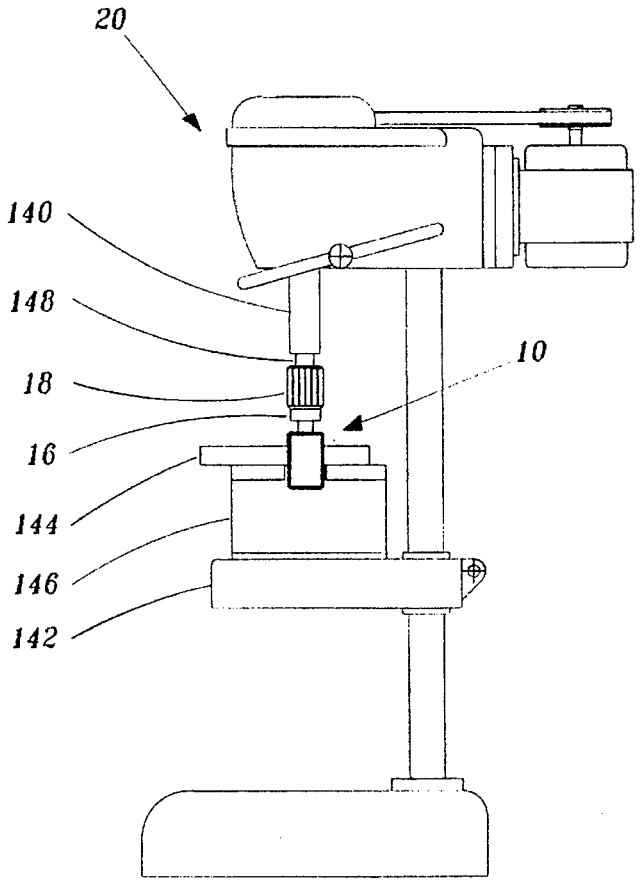
FIG. 2 is a side view of the present invention, mounted in a typical drill press.

A representative form of a sanding apparatus embodying the concepts of the present invention is designated generally by the numeral 10 on the accompanying drawings. The sanding apparatus 10 is supported by and receives its input power by way of a drive shaft 12. As may be seen in FIG. 1, a chuck portion 14 is disposed in the first end of the drive shaft 12. The chuck portion 14 is configured to be clamped in the jaws 16 of a chuck 18 of a standard drill press 20, as seen in FIG. 2. The drive shaft 12 first end may be modified to fit other power sources such as a radial arm saw, a lathe, a router, or other sources of rotary torque, The drive shaft 12 is generally cylindrical and may be fabricated from steel or other rigid material.

The drive shaft 12 supports a cross shaft 30. The cross shaft 30 extends perpendicularly from the drive shaft 12 at a suitable distance from the drill press chuck 18 to provide clearance for reciprocation. The cross shaft 30 may also be fabricated from steel or other rigid material. In the preferred embodiment of the present invention, the cross shaft 30 is rigidly connected by suitable means to the drive shaft 12. The first end 32 of the cross shaft 30 extends outward radially from the drive shaft 12. The first end 32 of the cross shaft 30 provides a bearing surface 34 for a cam driver 40 and the second end is connected to the drive shaft 12.

The cam driver 40 may be fabricated from heat treated steel to provide suitable wear characteristics to extend its life. Other alternate materials may be used to provide the same wear characteristics. In the preferred embodiment of the present invention. The outer surface 42 of the cam driver 40 is spherical to facilitate contact with a cam track 50. Other outer surface 42 contours may be used to reduce wear depending on the materials and configuration of the cam track 50. The inside diameter of the cam driver 40 is sufficiently large to provide a running or rotating fit with the first end 32 of the cross shaft 30. The cam driver 40 may be held on the cross shaft 30 by an appropriate keeper (not shown) or more simply by abutting the cam driver 40 by the drive shaft 12 on one end and a housing 60 at the other end. The cam driver 40 may also be removed and the first end 32 of the cross shaft 30 may function as the cam driver 40. In such an alternative embodiment, the cross shaft 30 may be rotatably received by the main shaft or the cross shaft 30 would act as a rigid cam driver 40.

A first cam 70 and a second cam 72 partially surround the drive shaft 12. Each cam 70,72 rotates and reciprocates about the drive shaft 12 at a variable rate. Each cam 70,72 is generally cylindrical in shape having a first end 74 and a second end 76. The first end 74 of each cam 70,72 is approximately perpendicular to the centerline 78 of the cams 70,72 while the second end 76 of each cam 70,72 forms an opposing side of the cam track 50. When the cams 70,72 are positioned about the drive shaft 12, the second ends 76 of the cams 70,72 cooperate to form the cam track 50—that is the cam track 50 includes the path formed by the opposing second ends 76 of each cam 70,72.

Figure 4:
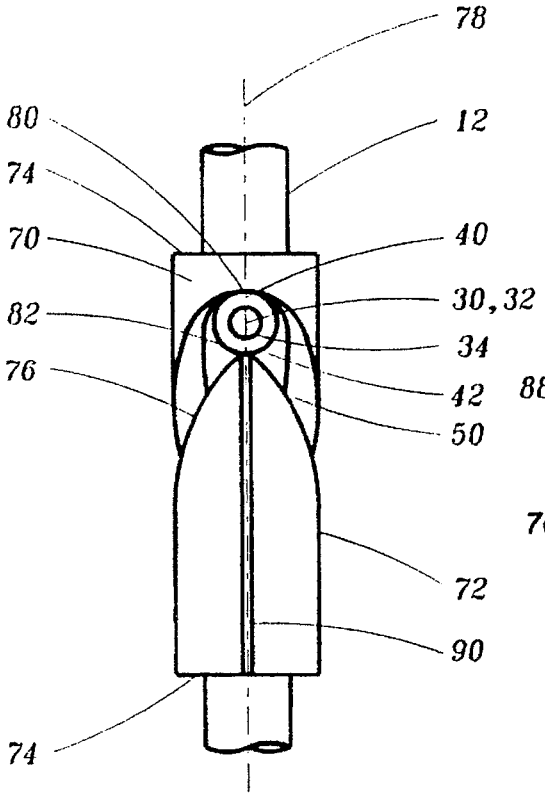
FIG. 4 is a partial side view showing the main shaft, the cam driver, and the first and second cams.
Figure 5:
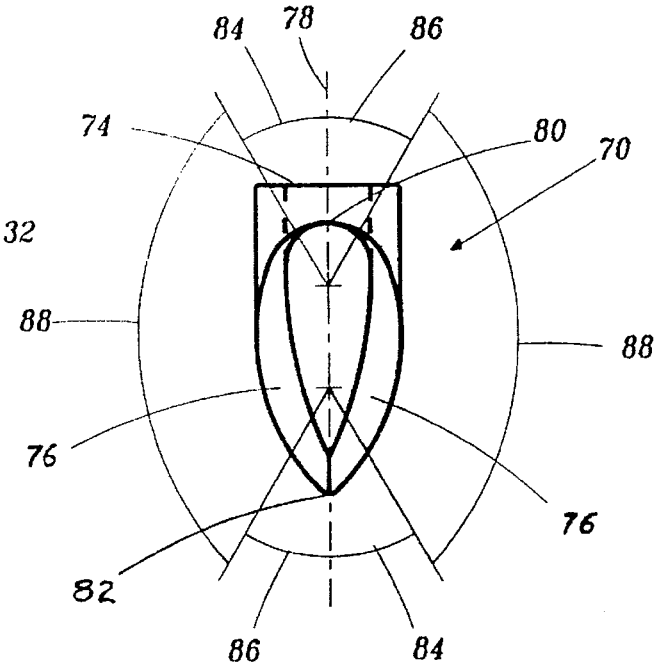
FIG. 5 is a side view of the first cam.
Figure 6:
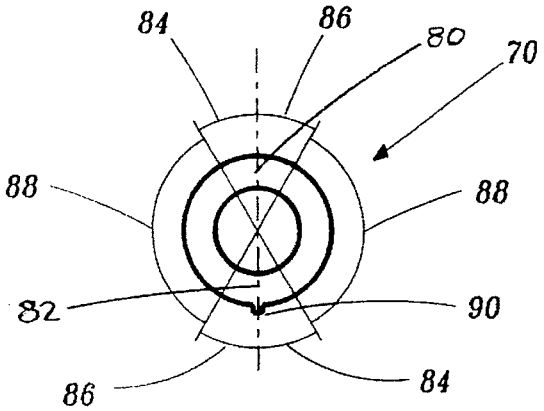
FIG. 6 is an end view of the first cam.
Figure 7:
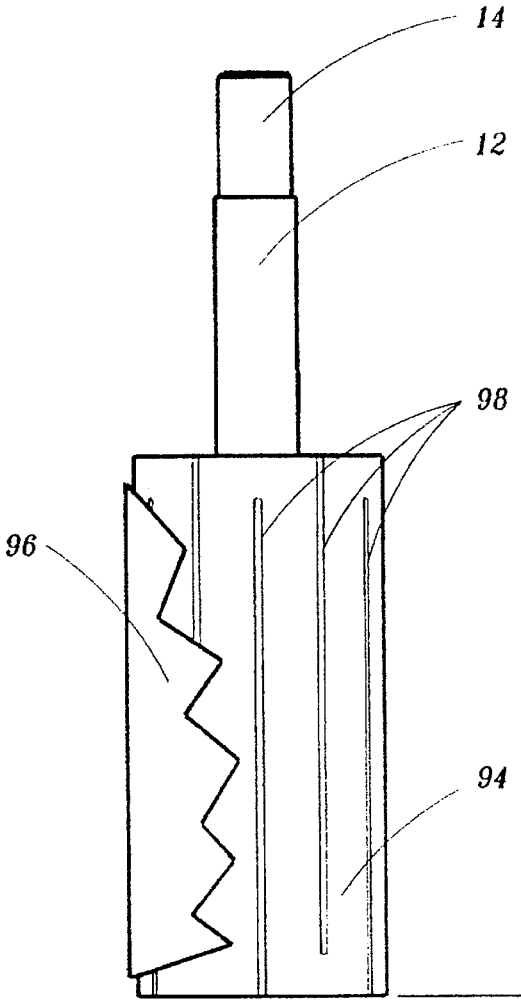
FIG. 7 is a side view of the present invention in the fully extended position; and, FIG. 8 is a side view of the present invention in the fully retracted position.
Figure 8:
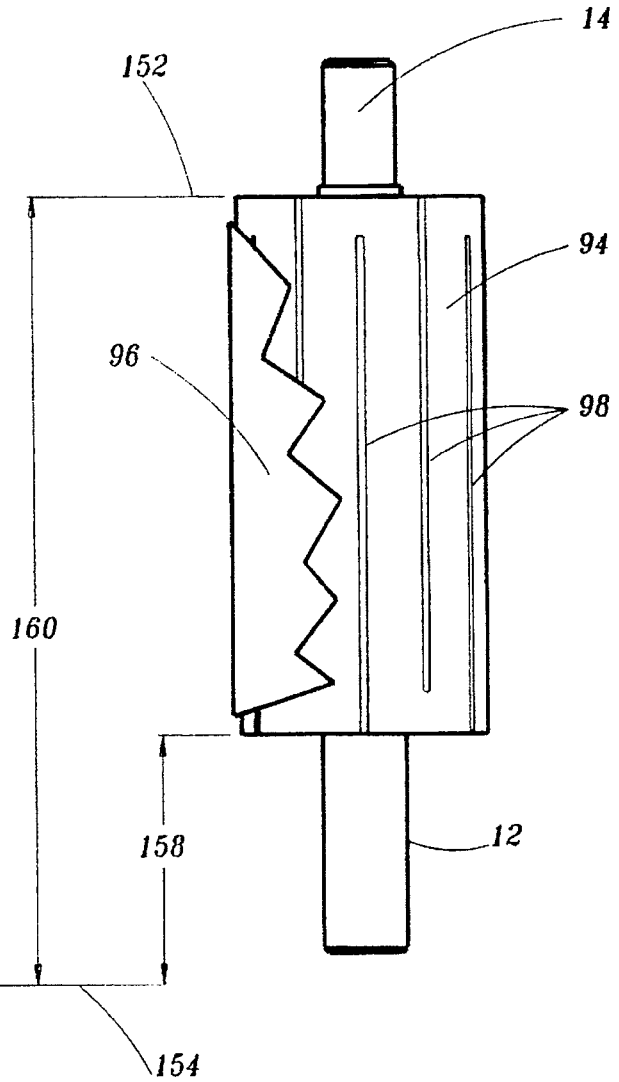

As may be seen in FIGS. 4–6, the cams 70,72 and the cam track 50 have a first extremity 80, second extremity 82, acceleration portion 84, deceleration portion 86, and a constant helix portion 88. The length and configuration of the cam track 50 may be altered without departing from the concepts and objects of the present invention. For instance, increasing the distance between the first 80 and second 82 extremities will increase the length of reciprocation. Similarly, shortening the distance between the first 80 and second 82 extremities will cause cams 70,72 to reciprocate at a faster rate but rotate at a slower rate. On the other hand, if the angle between the cam track 50 and the centerline 78 were reduced to zero, the cams 70,72 would not reciprocate.

The cam driver 40 is disposed between the second end 76 of the first cam 70 and the second end 76 of the second cam 72. In this manner, the cam driver 40 may be said to be riding in the cam track 50. The cams 70,72 may be fabricated from a rigid plastic material that permits molding. An alternative is to fabricate the cams 70,72 from powdered metal or rigid material or composite. Another alternative is to employ an oil-impregnated material that would eliminate the need for a lubricant. Additionally, the outer contours of the cams 70,72 need not be cylindrical. The interaction between the cam driver 40 and the cams 70,72 transform constant rotary input motion to variable rotary and variable reciprocating motion in the sanding apparatus 10.

The cams 70,72 are at least partially surrounded by and non-rotatably connected to the housing 60. The housing 60 may also be fabricated from the same rigid plastic material as the cams 70,72. As an alternate, the housing 60 could be made of powdered metal or other rigid materials. The housing 60 is generally cylindrical but may be slightly tapered for a purpose more fully described below. In an alternative embodiment of the present invention, the housing 60 may be in the shape of a right cylinder. In yet another embodiment of the present invention, the cams 70,72 would be joinable so that the housing 60 would not be required. In the preferred embodiment of the present invention, the cams 70,72 are restrained from rotation by an integral key 90 that fits into a key slot 92 in the housing 60. In alternative embodiments, the cams 70,72 may be restrained by other known means such as glue, pins, screws, bolts, interlocking members, and the like.

An expansion sleeve 94 slides over the tapered housing 60 and supports a section of sanding media 96. The outer surface of the sanding media 96 provides a sanding surface that at least partially surrounds the drive shaft 12. As described above, the outside surface of the housing 60 may be tapered. The inside surface of the expansion sleeve 94 is similarly tapered so that the fit between the two members is intimate. The tapering of the expansion sleeve 94 and the housing 60 allows the sanding apparatus 10 to overcome size variations of the inside diameter of the sanding media 96. Variations in size are inherent in the manufacturing process of the sanding media 96. A plurality of alternating slots 98 are cut into the expansion sleeve 94 to permit it to expand and retract. The expansion sleeve 94 is operated by moving the expansion sleeve 94 axially towards the larger end of the housing 60. As the sleeve approaches the larger end, the outside surface 100 of the housing 60 urges the expansion sleeve 94 to expand against the sanding media 96 that is wrapped around the expansion sleeve 94. After the expansion sleeve 94 is tightly connected to the housing 60, the sanding media 96 will not loosen or fall off the expansion sleeve 94 due to frictional forces. In an alternative embodiment of the present invention, the outside surface 100 of the housing 60 is not tapered. The sanding media 96 is then simply wrapped about the housing 60 and sanding is perfomed. It may now be understood that the cams 70,72 are operatively disposed between the sanding surface and the drive shaft.

Figure 3:
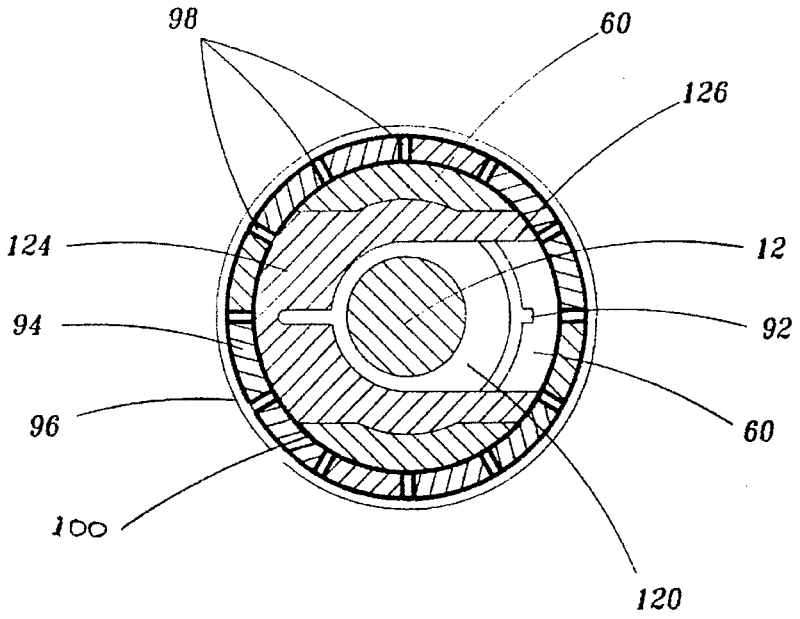
FIG. 3 is a cross sectional view taken along line 3—3 of FIG. 1.

A first seal 110 surrounds the drive shaft 12 in a tight fit in the housing first end 112 of the inside diameter of housing 60 and is retained from axial movement by first cam 70. A second seal 120 surrounds a portion of drive shaft 12 in a tight fit in the first end 74 of the second cam 72 and retained from axial movement by retainer 124. In an alternate embodiment of the present invention the seals 110,120 may be integrally formed in the cams 70,72. The retainer 124 shown in FIG. 3 is made of rigid plastic suitable for molding. Other alternate rigid materials are possible. The open end 126 of retainer 124 is compressed inward as it is inserted through the cylindrical housing 60. The retainer 124 is secured to the cylindrical housing 60 by extending through slot 128 in the cylindrical housing 60. After being fully inserted the retainer 124 expands outwardly to a position near it's free state into the inside diameter of the cylindrical housing 60 securing the retainer 124 from radial movement. By fitting through the slot 128, in the cylindrical housing 60, the retainer 124 retains all other components in the cylindrical housing 60. FIG. 3 shows a cross sectional view along line 3—3 through the sanding apparatus 10 through the center of the retainer 124.

Referring now to FIG. 2, a sanding apparatus 10 according to the present invention may be seen mounted in a typical drill press 20. The chuck position 14 of a drive shaft 12 is mounted in a chuck 18 in the same manner as a drill bit is mounted in the chuck 18. The drill press quill 140 locked to prevent vertical motion. The drill press table 142 is used to support the work piece 144 being sanded or a sanding table 146 that may be clamped to the drill press table 142. As may be seen, the sanding apparatus 10 is only supported by the drill press chuck 18.

While the device in accordance with the present invention will be described hereinafter with respect to use in a conventional drill press 20, it is obvious that the device can be used in other applications such as hand operated power tools.

OPERATION

The drive shaft 12 of sanding apparatus 10 is mounted securely in the jaws 16 of a chuck 18 that is attached to the spindle 148 of drill press 20. The drill press 20 provides support and through the use of a drive motor 150 rotational power, or rotary torque, for the sanding apparatus 10. Drill press table 142 either supports the work piece 144 or a suitable sanding table 146, supporting the work piece 144.

Energizing the drive motor 150 causes the sanding apparatus 10 to rotate because rotary torque is transferred from the drill press 20 to the drive shaft 12. Without moving the work piece 144 against the sanding media 96 the sanding apparatus 10 is in the idle state, all components rotate together at the speed of the drill press 20 with no reciprocation. A sanding load must be applied to make the sanding apparatus 10 switch from the idle state to the reciprocating state.

A sanding load is created when the work piece 144 is forced against the rotating sanding media 96. The abrasive face of the sanding media 96 provides many cutting edges that abrade the surface of the work piece 144. Reciprocation of the sanding media 96 is required to expose a greater area of the sanding media 96 to the work piece 144. Further, this reciprocation allows the sanding media 96 to rid itself of cuttings when it is reciprocated away from the work piece 144 also keeping the sanding media 96 and work piece 144 temperature from rising to a level that defaces the work piece 144. The torque necessary to rotate the sanding media 96 against the work piece 144 is dependent upon the pressure the operator applies forcing the work piece 144 against the sanding media 96.

As an operator increases the pressure of the work piece 144 against the sanding media 96 the torque required to rotate the sanding media 96 increases. This torque is required to provide the cutting action of the sanding media 96. When the operator increases pressure sufficiently to overcome the inherent frictional resistance between the drive shaft 12 and all other components in contact with the drive shaft 12 all components except the drive shaft 12, the cross shaft 30 and the cam driver 40 start to reciprocate.

The fictional and sanding loads create enough torque to cause relative motion between the cams 70,72 and the drive shaft 12. This motion causes the cross shaft 30 through the cam driver 40 to drive the first cam 70 up or the second cam 72 down dependent upon the radial position the cams 70,72 in respect to the cross shaft 30. The first cam 70 and the second cam 72 are fixed to the cylindrical housing 60 causing all other components fixed to the cams 70,72 to reciprocate and rotate as a unit. The cams 70,72 are thus operatively confined between the drive shaft 12 and the housing 60.

In part, the helix angle of the cams 70,72 determines the axial component of force applied to the cam track 50. The axial component is the force that drives upper cam 70 and all components fixed to it, towards the chuck portion 14 of drive shaft 12. Likewise, this axial component is the force that drives lower cam 70 and all components fixed to it, away from the chuck portion 14 of drive shaft 12.

The ratio of axial movement to rotational movement of the cams 70,72 and all components fixed to them is dependent upon the helix angle of the cams 70,72 and the torque required to provide rotation of the sanding media 96 against the work piece 144. The greater the pressure applied by the work piece 144 against the sanding media 96 the higher the torque required to rotate the unit. This higher torque generates a higher force through cam driver 40 against the first cam 70 and second cam 72 moving them and all other components fixed to them at a faster axial rate. This action is continuous as long as the sanding load generates enough torque to overcome the inherent frictional resistance between drive shaft 12 and all other components in contact with the drive shaft 12. Therefore, part of the rotational motion from drive shaft 12 through cam driver 40 is converted to reciprocation motion.

Both the first cam 70 and the second cam 72 have the same cam profiles. These profiles have acceleration portion 84, a deceleration portion 86, and a constant helix portion 88. The reciprocating speed of the cams 70,72 and all components fixed to them varies from zero at the first travel extremity 152 and second travel extremity 154 to a maximum speed in the center two-thirds of the stroke 158. The contour of the first cam 70 and the second cam 72 controls this speed profile. The direction and speed of the cam driver 40 also varies accordingly. The cam profiles provide smooth reciprocating action over the total travel envelope 160 and especially at the ends of the stroke 158 where the reversal occurs. The geometry of the cam contour also makes the second extremity 82 blunter, providing sufficient strength for the action of the cam driver 40.

Both the first seal 110 and the second seal 120 are dynamic shaft seals that restrict entrance of contaminants into the internal areas of the sanding apparatus 10 and prevent loss of lubricant. If the embodiment contains first cam 70 and second cam 72 made from lubricant impregnated materials then the seals are only used to restrict entrance of contaminants.

Since all reciprocating motion is a direct result of the resistance to rotation, caused by the pressure of the work piece 144 exerted against the sanding media 96, the sanding apparatus 10 has an inherent variable speed of reciprocation. This feature is especially useful during heavy sanding when the sanding media 96 is especially conducive to loading, resulting in poor sanding media 96 lift and work piece 144 burning.

As should now be apparent, the present invention not only provides a sanding apparatus that provides variable rotating and reciprocating motion but also otherwise accomplishes the objects of the invention.

I claim:

1. A sanding apparatus, comprising:

a drive shaft;

a sanding surface at least partially surrounding said drive shaft; and, means operatively disposed between said sanding surface and said drive shaft for transforming constant rotary motion applied to said drive shaft to variable rotation and variable reciprocation in said sanding surface.

2. An apparatus as set forth in claim 1, wherein:

said means comprises first and second cams;

each of said cams partially surrounding said drive shaft.

3. An apparatus as set forth in claim 2, wherein:

said first and second cams cooperate to form a cam track;

said first cam has a first end and a second end, said second end being one part of said cam track;

said second cam has a first end and a second end, said second end being another part of said cam track.

4. An apparatus as set forth in claim 3, further comprising:

a cross shaft;

said cross shaft being supported by said drive shaft;

said cross shaft having a first end disposed in said cam track.

5. A sanding apparatus, comprising:

a drive shaft;

a sanding surface at least partially surrounding said drive shaft;

first and second cams partially surrounding said drive shaft for transforming constant rotary motion applied to said drive shaft to variable motion in said sanding surface;

said first and second cams cooperating to form a cam track;

said first cam having a first end and a second end, said second end being one part of said cam track;

said second cam having a first end and a second end, said second end being another part of said cam track;

a cross shaft;

said cross shaft being supported by said drive shaft;

said cross shaft having a first end disposed in said cam track;

a source of rotary torque;

housing means operatively connecting said sanding surface to said first and second cams; and, said drive shaft being operatively connected to said source of rotary torque whereby said cross shaft drives said first and second cams in variable rotary and variable reciprocating motion.

6. An apparatus as set forth in claim 5, wherein said sanding surface rotates and reciprocates along with said first and second cams between a first travel extremity and a second travel extremity.

7. An apparatus as set forth in claim 6, further comprising a cam driver operatively connected to said cross shaft, said cam driver riding in said cam track.

8. A sanding apparatus, comprising:

a drive shaft;

a sanding surface at least partially surrounding said drive shaft;

first and second cams partially surrounding said drive shaft for transforming constant rotary motion applied to said drive shaft to variable motion in said sanding surface; and, housing means at least partially disposed between said sanding surface and said first and second cams for adjustably supporting said sanding surface.

9. An apparatus as set forth in claim 8, wherein said housing means comprises:

a tapered housing operatively connected to said first and second cams; and, an expansion sleeve at least partially disposed between said housing and said sanding surface;

said expansion sleeve having a plurality of slots;

said expansion sleeve also being tapered.

10. An apparatus for sanding, comprising:

a drive shaft;

a cross shaft supported by said drive shaft;

said cross shaft having first and second ends;

first and second cams partially surrounding said drive shaft;

said first and second cams cooperating to form a cam track;

said first end of said cross shaft being disposed in said cam track; and, a sanding surface operatively connected to said first and second cams.

11. An apparatus as set forth in claim 10, further comprising housing means at least partially disposed between said sanding surface and said first and second cams for connecting said first and second cams and for supporting said sanding surface.

12. An apparatus as set forth in claim 11, wherein said housing means comprises:

a housing operatively connected to said first and second cams; and, an expansion sleeve at least partially disposed between said housing and said sanding surface.

13. An apparatus as set forth in claim 12, further comprising:

a first seal;

said first seal operatively connected to said tapered housing;

said first seal at least partially surrounding said drive shaft;

a second seal;

said second seal operatively connected to said second cam;

said second seal at least partially surrounding said drive shaft; and a retainer operatively connected to said tapered housing.

14. An apparatus as set forth in claim 10, wherein:

said first cam having a first end and a second end;

said second end being one part of said cam track; and, said second cam having a first end and a second end;

said second end being another part of said cam track.

15. An apparatus as set forth in claim 14, wherein said first end of said cross shaft is disposed between said second end of said first cam and said second end of said second cam.

16. An apparatus as set forth in claim 15, further comprising:

a source of rotary torque;

said drive shaft operatively connected to said source of rotary torque such that said cross shaft rotates against said first and second cams causing said first and second cams to rotate at a variable rate and to reciprocate about said drive shaft at a variable rate.

17. An apparatus as set forth in claim 16, further comprising:

a cam driver;

said cam driver being operatively connected to said first end of said cross shaft;

said cam driver riding in said cam track.

18. A sanding apparatus for providing variable rate rotation and variable rate reciprocation, said apparatus comprising:

a drive shaft;

a cross shaft supported by said drive shaft;

said cross shaft having first and second ends;

first and second cams partially surrounding said drive shaft;

said first and second cams cooperating to form a cam track;

said first end of said cross shaft being disposed in said cam track;

a tapered housing at least partially surrounding said first and second cams;

said tapered housing being operatively connected to each of said first and second cams;

said tapered housing having a tapered outer surface;

an expansion sleeve at least partially surrounding said tapered housing;

said expansion sleeve having a tapered inner surface;

said expansion sleeve being slotted; and, a sanding surface operatively connected to said expansion sleeve.

19. An apparatus as claimed in claim 18, wherein said cross shaft drives said first and second cams in variable reciprocating and variable rotating motion when said drive shaft is subjected to rotary motion.

20. An apparatus as claimed in claim 18, wherein said cam track is helical.

* * * * *